US007290488B2

(12) United States Patent
Petersen et al.

(10) Patent No.: US 7,290,488 B2
(45) Date of Patent: Nov. 6, 2007

(54) APPARATUS AND METHOD FOR CHANGING PRINTING SLEEVES ON A PRINTING MACHINE

(75) Inventors: Godber Petersen, Augsburg (DE); Josef Göttling, Friedberg (DE); Thomas Hartmann, Mering (DE)

(73) Assignee: MAN Roland Druckmaschinen AG, Offenbach (DE)

( * ) Notice: Subject to any disclaimer, the term of this patent is extended or adjusted under 35 U.S.C. 154(b) by 15 days.

(21) Appl. No.: 11/121,776

(22) Filed: May 4, 2005

(65) Prior Publication Data

US 2005/0252399 A1 Nov. 17, 2005

(30) Foreign Application Priority Data

May 5, 2004 (DE) ..... 10 2004 022 181

(51) Int. Cl.
*B41F 13/00* (2006.01)

(52) U.S. Cl. ..... 101/479; 101/375; 101/379

(58) Field of Classification Search ..... None
See application file for complete search history.

(56) References Cited

U.S. PATENT DOCUMENTS

| | | | | |
|---|---|---|---|---|
| 3,146,709 | A * | 9/1964 | Bass et al. | 101/375 |
| 4,004,509 | A * | 1/1977 | Moss | 101/216 |
| 4,823,693 | A * | 4/1989 | Kobler | 101/218 |
| 4,913,048 | A * | 4/1990 | Tittgemeyer | 101/141 |
| 5,706,731 | A | 1/1998 | Francille et al. | |
| 5,752,444 | A * | 5/1998 | Lorig | 101/375 |
| 5,782,181 | A | 7/1998 | Rossini | |
| 5,819,657 | A | 10/1998 | Rossini | |
| 5,878,666 | A * | 3/1999 | Schneider et al. | 101/217 |
| 6,389,965 | B1 * | 5/2002 | Vrotacoe et al. | 101/217 |
| 6,401,613 | B1 | 6/2002 | Gayle et al. | |
| 6,578,483 | B2 * | 6/2003 | Compera et al. | 101/375 |
| 6,782,821 | B2 | 8/2004 | Dilling et al. | |
| 6,792,858 | B2 * | 9/2004 | Kolbe et al. | 101/376 |
| 6,874,415 | B2 * | 4/2005 | Hoffmann et al. | 101/217 |
| 2004/0139873 | A1 * | 7/2004 | Gottling et al. | 101/375 |

FOREIGN PATENT DOCUMENTS

| | | |
|---|---|---|
| DE | 10024001 A1 | 11/2001 |
| DE | 20219715 U1 | 3/2003 |
| EP | 1010522 A1 | 6/2000 |

* cited by examiner

*Primary Examiner*—Jill E. Culler
(74) *Attorney, Agent, or Firm*—Leydig, Voit & Mayer, Ltd

(57) ABSTRACT

The invention provides an apparatus for the mounting and/or demounting of at least two printing sleeves outside a printing unit of a printing machine. The printing sleeves include an outer printing sleeve forming a printing surface and an inner printing sleeve providing diameter compensation between the outer printing sleeve and an impression cylinder of the printing machine. The apparatus having a reception device onto which an inner printing sleeve can be pushed for mounting the two printing sleeves. The apparatus having at least one compressed-air device for facilitating the fixing of the inner printing sleeve on the reception device and for conducting compressed air through orifices assigned to the inner printing sleeve in order thereby to make it possible for an outer printing sleeve to be pushed more easily onto the inner printing sleeve.

4 Claims, 6 Drawing Sheets

APPARATUS AND METHOD FOR CHANGING PRINTING SLEEVES ON A PRINTING MACHINE

FIELD OF THE INVENTION

The present invention relates to an apparatus for mounting and/or removal of a plurality of printing sleeves on a printing machine. The invention also relates to a method for changing printing sleeves on a printing machine.

BACKGROUND OF THE INVENTION

In printing operations, a current practice is to position what may be referred to as printing sleeves on impression cylinders of a printing machine. Such printing sleeves allow a smooth and jolt-free rolling of the cylinders of a printing machine that are involved in printing. Where printing machines of variable format are concerned, two printing sleeves are positioned one above the other on the impression cylinders. An outer printing sleeve forms a printing surface, and an inner printing sleeve serves for diameter compensation between the outer printing sleeve and the respective impression cylinder of the printing machine. In such cases, the outer printing sleeve usually has a small wall thickness, whereas the inner printing sleeve has a larger wall thickness, depending on the difference in diameter between the respective impression cylinder and the outer printing sleeve.

To execute a production change between two different printing orders, at least the outer printing sleeve forming the printing surface must be changed. For a production change between two printing orders which are characterized by the same printing format, only the outer printing sleeve has to be changed. If, however, the two printing orders also differ from one another in terms of their printing format, then the inner printing sleeve must also be exchanged in addition to the outer printing sleeve.

According to the prior art, the changing or exchanging procedure for printing sleeves on a printing machine is carried out directly on the impression cylinder and consequently within the printing machine. In order to permit an exact alignment of the inner printing sleeve and outer printing sleeve on the impression cylinder, the impression cylinders of the printing machine must have a complex construction. Furthermore, carrying out the mounting work and/or demounting work directly on the impression cylinder and consequently within the printing machine may lead to long production down time of the printing machine. The mounting and/or demounting of the printing sleeves directly on the impression cylinder and consequently within the printing machine is therefore generally a disadvantage.

BRIEF SUMMARY OF THE INVENTION

In view of the foregoing, a general object of the present invention is to provide an apparatus for the mounting and/or demounting of at least two printing sleeves that can be used to mount and/or demount the printing sleeves outside the printing machine. A further object of the present invention is to provide a method for changing printing sleeves on a printing machine.

The apparatus according to the invention serves for the mounting and/or demounting of at least two printing sleeves outside a printing unit of a printing machine. In particular, the apparatus of the present invention permits the mounting and/or demounting of an outer printing sleeve forming a printing surface, a blanket sleeve or of an inner printing sleeve providing diameter compensation between the outer printing sleeve and an impression cylinder of the printing machine. The apparatus according to the invention including at least the following subassemblies: a) a reception device onto which an inner printing sleeve can be pushed for the mounting of the two printing sleeves; and b) at least one compressed-air device for helping to fix the inner printing sleeve on the reception device and for conducting compressed air through orifices assigned to the inner printing sleeve for the mounting of the two printing sleeves. The latter compressed-air device thereby allows for an outer printing sleeve to be pushed more easily onto the inner printing sleeve.

BRIEF DESCRIPTION OF THE SEVERAL VIEWS OF THE DRAWING(S)

DETAILED DESCRIPTION OF THE INVENTION

The present invention is described in greater detail below with reference to FIGS. 1 to 6. FIGS. 1 to 6 show three different exemplary embodiments of an apparatus according to the invention for the mounting and/or demounting of two printing sleeves outside a printing unit of a printing machine. In particular, the apparatus can be used for the mounting and/or demounting of an outer printing sleeve and of an inner printing sleeve. In such a case, the outer printing sleeve forms a printing surface and the inner printing sleeve provides diameter compensation between the outer printing sleeve and an impression cylinder of a printing machine.

Figure 1:
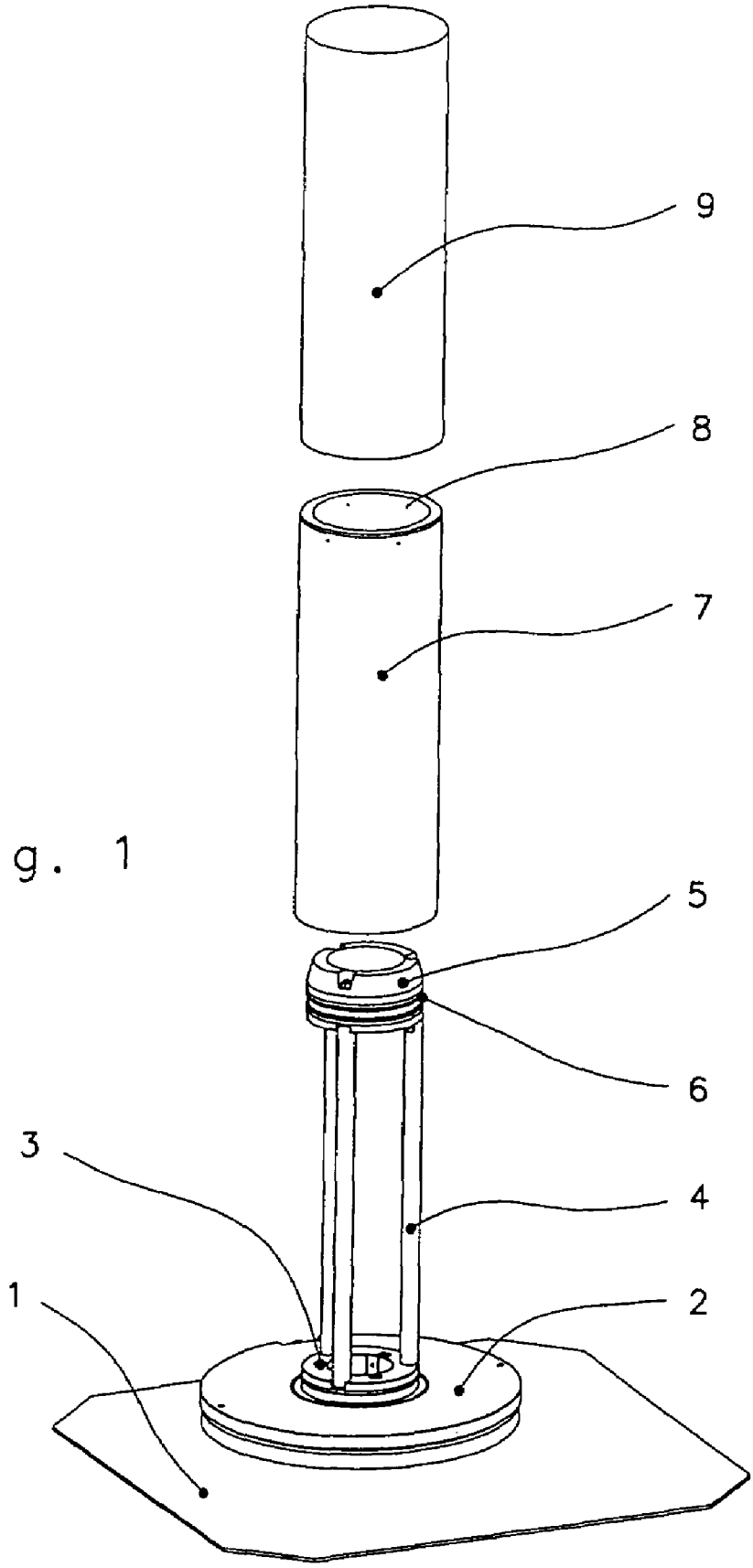
FIG. 1 is a side perspective view of an exemplary apparatus according to the invention for the mounting and/or demounting of printing sleeves showing two printing sleeves in a first state.
Figure 2:
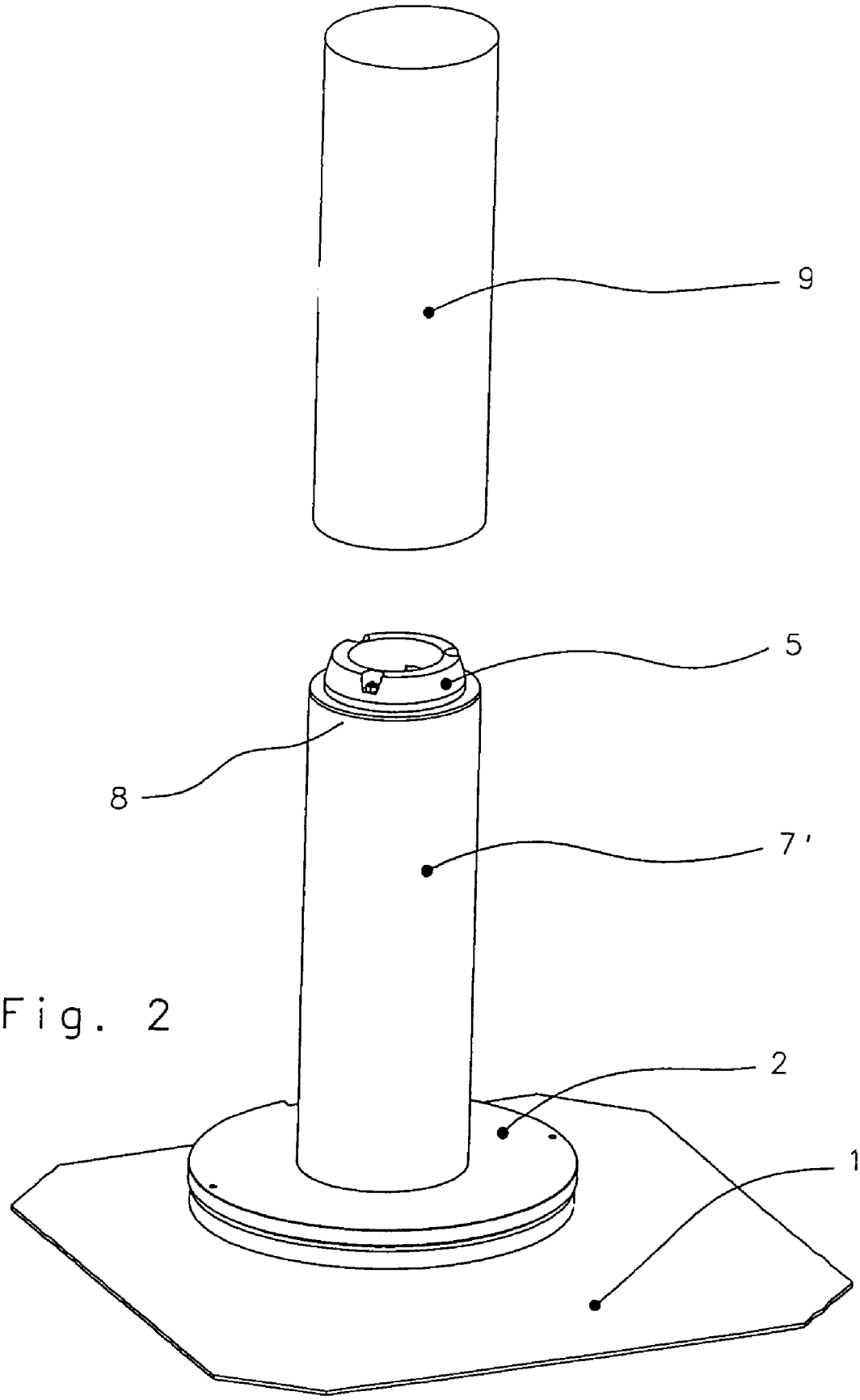
FIG. 2 is a side perspective view of the apparatus of FIG. 1 showing the two printing sleeves in a second state.

A first exemplary embodiment of the apparatus according to the invention is shown in FIGS. 1 and 2. In the embodiment of FIGS. 1 and 2, the apparatus according to the invention is mounted on a baseplate 1 that extends essentially in a horizontal direction. The apparatus includes a reception device that is mounted on a plate forming a stop element 2. In the embodiment of FIGS. 1 and 2, the reception device is formed by two centering elements 3 and 5. A first centering element 3 is mounted on the stop element 2 and is connected to a second centering element 5 via a total of three struts serving as spacers 4. A seal 6 is integrated into the second centering element 5.

Mounting of two printing sleeves (e.g., an inner printing sleeve 7 and of an outer printing sleeve 9) utilizing the apparatus according to the invention involves first pushing the inner printing sleeve 7 (see FIG. 1) onto the reception device consisting of the two centering elements 3 and 5 that are connected to one another via the spacers 4. In this case, an outside diameter of the centering elements 3 and 5 is adapted to an inside diameter of the inner printing sleeve 7. FIG. 2 shows the inner printing sleeve 7 in a position in which the printing sleeve is pushed completely onto the reception device and with a lower end bearing against the stop element 2. Thus, for mounting the two printing sleeves 7 and 9, the inner printing sleeve is moved out of the position identified in FIG. 1 by the reference numeral 7 into the position identified in FIG. 2 by the reference numeral 7'.

In addition to the reception device that is formed from the two centering elements 3 and 5 and the spacers 4, the apparatus has a compressed-air device. The compressed air device helps push the inner printing sleeve 7 onto the reception device. The compressed air device can be fixed on the reception device for the mounting of the two printing sleeves 7 and 9. Through the compressed-air device, the seal 6, which is formed by two sealing rings in the illustrated embodiment, is pressed or forced against the inner wall of the inner printing sleeve 7. This ensures that the inner printing sleeve 7 or 7' is fixed to the reception device.

The apparatus according to the invention also has a compressed-air device for conducting compressed air through orifices 8 which are introduced into the inner printing sleeve 7 or 7'. As a result, an air film can be formed on an outer wall of the inner printing sleeve 7 or 7' which makes it easier for the outer printing sleeve 9 to be pushed onto the inner printing sleeve 7 or 7'. This compressed-air device can be the same compressed-air device that serves for pressing the seal 6 against the inner wall of the inner printing sleeve 7 or 7'. However, the two compressed-air devices may also be designed as separate subassemblies.

After the outer printing sleeve 9 has been pushed completely onto the inner printing sleeve 7 or 7', the compressed-air device (or devices) is deactivated and the mounted printing sleeves 7 and 9 can be lifted off as a unit from the reception device and supplied to an impression cylinder of a printing machine.

The apparatus according to the invention is also suitable for demounting two printing sleeves that are connected to one another and extracted from a printing machine. For this purpose, the printing sleeves connected to one another are extracted as a unit from a printing machine and are positioned as a unit on the reception device. With the aid of the compressed-air device (or devices), the unit comprising the two printing sleeves connected to one another is then fixed in its position on the reception device, and air is conducted between the two printing sleeves, so that the outer printing sleeve can thereby be drawn off more easily from the inner printing sleeve. Once the outer printing sleeve is demounted from the inner printing sleeve, the inner printing sleeve can also be lifted off from the reception device.

In the embodiment of FIGS. 1 and 2, the reception device of the apparatus for mounting and/or demounting of the printing sleeves 7 and 9 is oriented in such a way that the inner printing sleeve 7 (or 7') and the outer printing sleeve 9 can be mounted and/or demounted in a vertical position, i.e. with vertically oriented longitudinal mid-axes.

Figure 3:
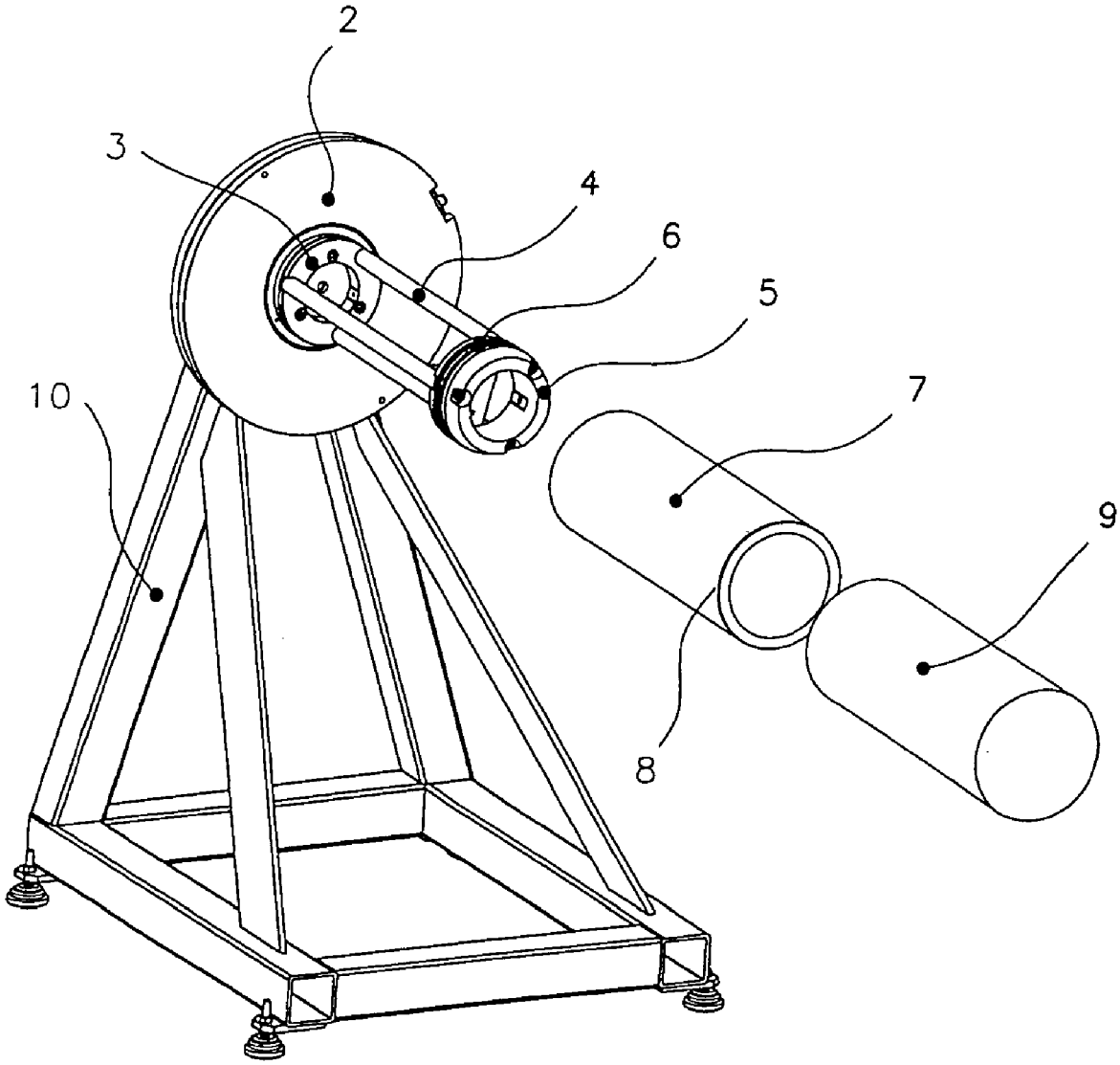
FIG. 3 is a side perspective view of an alternative embodiment of an apparatus according to the invention for the mounting and/or demounting of printing sleeves showing two printing sleeves in a first state.
Figure 4:
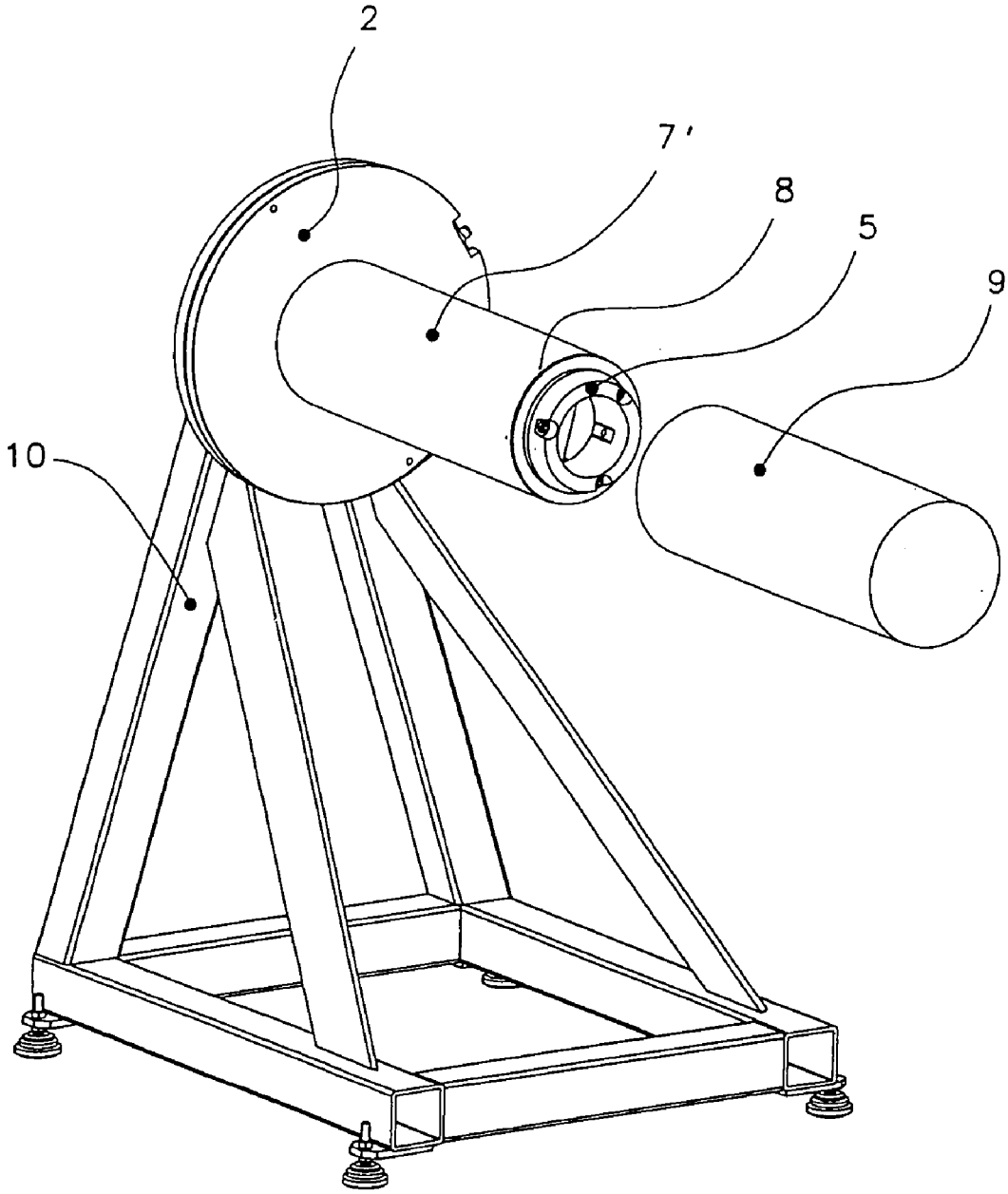
FIG. 4 is a side perspective view of the apparatus of FIG. 3 showing the two printing sleeves in a second state.

A second exemplary embodiment of an apparatus according to the invention for the mounting and/or demounting of two printing sleeves outside a printing unit of a printing machine is shown in FIGS. 3 and 4. The apparatus of the embodiment of FIGS. 3 and 4 differs from the apparatus of the exemplary embodiment of FIGS. 1 and 2 essentially in that the reception device consisting of the two centering elements 3 and 5 that are connected to one another via the spacers 4 is oriented in such a way that the inner printing sleeve 7 or 7' and the outer printing sleeve 9 can be mounted and/or demounted in a horizontal position (i.e. with horizontally oriented longitudinal mid-axes).

For this purpose, in the embodiment of FIGS. 3 and 4, the plate forming the stop element 2 is mounted on a stand 10, not on the baseplate 1 as in the embodiment of FIGS. 1 and 2. As compared with the embodiment of FIGS. 1 and 2, the embodiment of FIGS. 3 and 4 has the advantage that the mounting and demounting of the printing sleeves 7 and 9 can be carried out in a more convenient working position. Preferably, in this case, the fastening position of the stop element 2 on the stand 10 is variable, so that the working height relative to the reception device can thereby be set individually. Since, as regards the remaining details, the embodiment of FIGS. 3 and 4 is identical to the embodiment of FIGS. 1 and 2, the same reference numerals have been used here for identical subassemblies.

Figure 5:
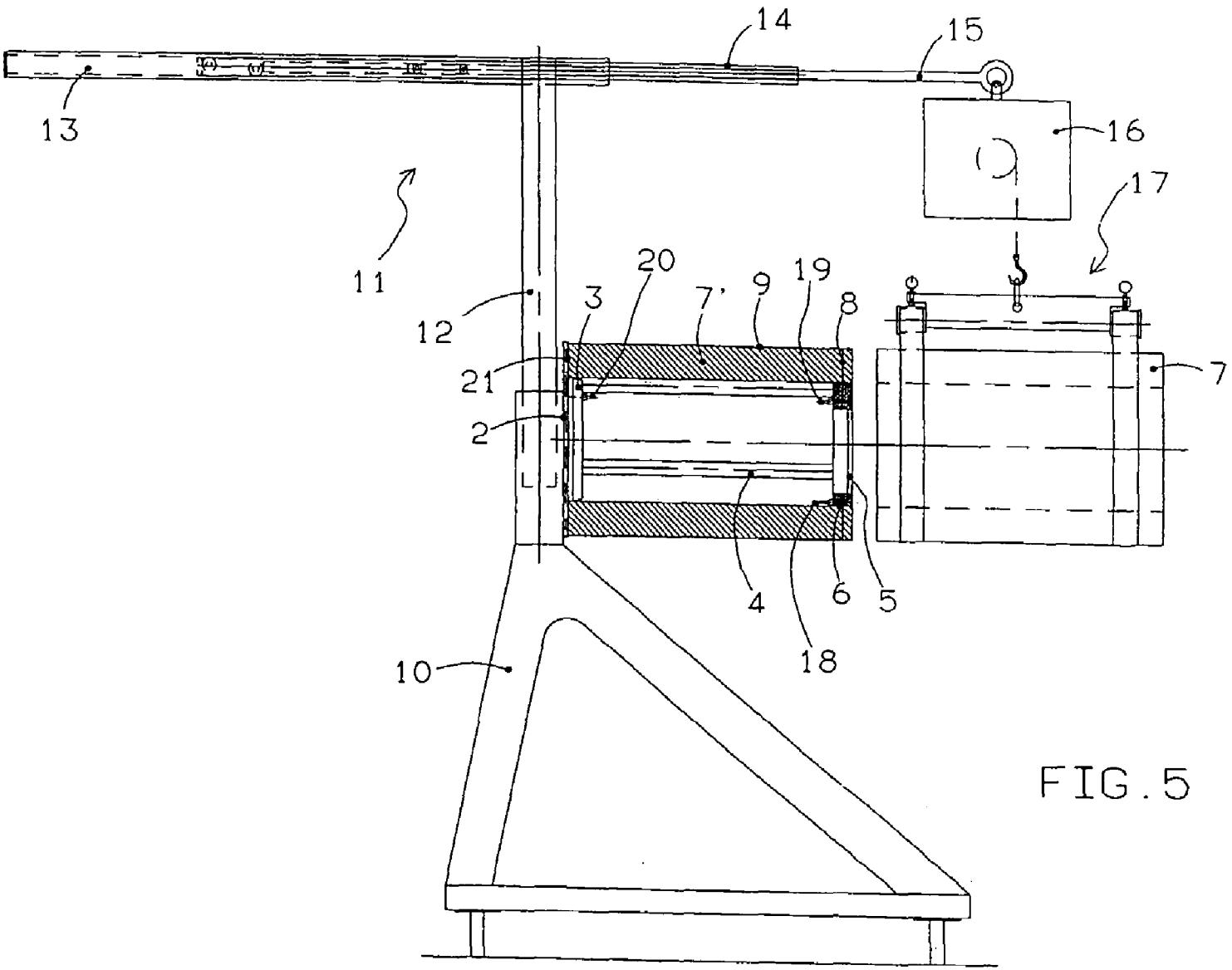
FIG. 5 is a side view of another alternative embodiment of an apparatus according to the invention for the mounting and/or demounting of printing sleeves.
Figure 6:
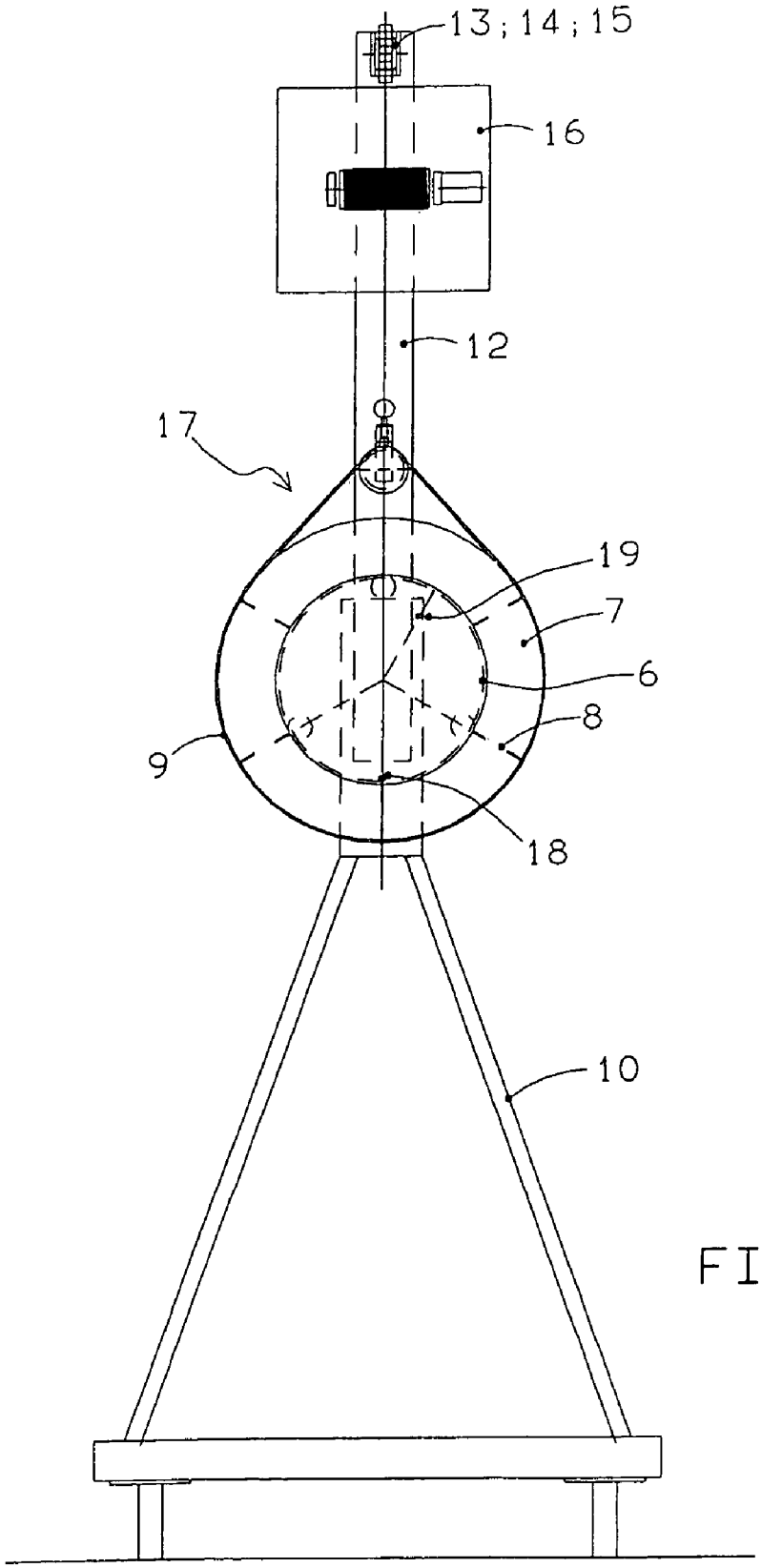
FIG. 6 is a front view of the apparatus of FIG. 5.

A third exemplary embodiment of an apparatus according to the invention for the mounting and/or demounting of two printing sleeves outside a printing unit of a printing machine is shown in FIGS. 5 and 6. The embodiment of FIGS. 5 and 6 is a preferred modification of the embodiment of FIGS. 3 and 4. To avoid unnecessary repetition, therefore, the same reference numerals are also used for identical subassemblies.

In the embodiment of FIGS. 5 and 6, the stand 10 is assigned a lifting device 11. The lifting device 11 comprises a first, essentially vertically extending carrier 12 that is rotatably anchored at one end in the stand 10. A substantially horizontally extending carrier 13 engages on an opposite end of the substantially vertically extending carrier 12. The horizontally extending carrier 13 has cooperating with it two further horizontally running carriers 14 and 15 that can be moved telescopically into and out of the carrier 13. The carrier 15 is assigned a winch 16. A suspension device 17 for the transport or movement of printing sleeves is fastened to the winch 16. As a result of the rotation of the lifting device 11 about the vertically extending axis of the vertical carrier 12, in conjunction with the telescopic movement of the carriers 14 and 15 in and out of the carrier 13 and the raising and lowering of the winch 16, the suspension device 17 can be moved into any desired position in space which lies within the radius of action of the apparatus. With the aid of the lifting device 11, in particular, heavy printing sleeves can be supplied to the apparatus according to the invention simply and conveniently.

FIG. 5 also shows compressed-air devices 18, 19 and 20 that aid the mounting and demounting of the two printing sleeves 7 and 9. The compressed-air devices 18 and 19 are the compressed-air devices described above. These compressed air devices facilitate the fixing of the inner printing sleeve 7 or 7' to the reception device by the seal 6 being pressed against an inner wall of the inner printing sleeve 7 or 7' and conduct compressed air through the orifices 8 of the inner printing sleeve 7 or 7' to make it easier to push the outer printing sleeve 9 onto and draw it off from the inner printing sleeve 7 or 7'. A further compressed-air device 20 serves for generating a vacuum in an annular chamber 21 between the stop element 2 and the inner printing sleeve 7 or 7'. As a result, the inner printing sleeve 7 or 7' can be fixed even more reliably in the region of the reception device. This is particularly advantageous when two printing sleeves stuck together by a printing ink are removed as a unit from a printing machine and have to be separated from one another.

With the aid of the apparatus according to the invention, printing sleeve mounting and demounting work operations can be undertaken outside a printing unit and therefore outside a printing machine. As a result, the time and effort expended on such operations is markedly reduced. Thus, production changes or format changes between two printing orders can be carried out more quickly. Production downtime of the printing machine is therefore reduced.

With respect to the present invention, to change printing sleeves on a printing machine, a first outer printing sleeve and a first inner printing sleeve are first extracted as a unit from an impression cylinder and are separated from one another outside a printing machine. In a second step, a second outer printing sleeve and a second inner printing sleeve are mounted outside the printing machine and are arranged as a unit on an impression cylinder of the printing machine. The demounting of the outer printing sleeve and of the inner printing sleeve and the mounting of these take place, using the above-described apparatus according to the invention.

LIST OF REFERENCE SYMBOLS

1. Baseplate
2. Stop element
3. Centering element
4. Spacer
5. Centering element
6. Seal
7. 7' Inner printing sleeve
8. Orifice
9. Outer printing sleeve
10. Stand
11. Lifting device
12. Carrier
13. Carrier
14. Carrier
15. Carrier
16. Winch
17. Suspension device
18. Compressed-air system
19. Compressed-air system
20. Compressed-air system
21. Chamber
22. Reception device

The invention claimed is:

1. An apparatus for mounting and/or demounting of a plurality of printing sleeves outside a printing unit of a printing machine, the plurality of printing plates including an outer printing sleeve and an inner printing sleeve providing diameter compensation between the outer printing sleeve and an impression cylinder of the printing machine, the apparatus comprising:

a reception device onto which the inner printing sleeve can be pushed for receiving the plurality of printing sleeves, said reception device including a plurality of centering elements that are connected to one another via spacers;

at least one compressed-air device for facilitating fixing of the inner printing sleeve on the reception device for the mounting of the two printing sleeves, and said at least one compressed-air device being operable to conduct compressed through orifices assigned to the inner printing sleeve to thereby facilitate pushing the outer printing sleeve onto the inner printing sleeve.

2. The apparatus according to claim 1, wherein the plurality of centering elements includes a first centering element mounted on a plate forming a stop element and a second centering element connected to the first centering element via the spacers.

3. The apparatus according to claim 1, wherein an outside diameter of the centering elements is adapted to an inside diameter of the inner printing sleeve.

4. The apparatus according to claim 1, wherein a seal is integrated into at least one centering element, the seal being capable of being pressed against an inner wall of the inner printing sleeve via a compressed-air device for the fixing of the inner printing sleeve.

* * * * *